US006634906B1

(12) United States Patent
Yeh

(10) Patent No.: US 6,634,906 B1
(45) Date of Patent: Oct. 21, 2003

(54) COAXIAL CONNECTOR

(76) Inventor: Min Hwa Yeh, P.O. Box 54-134, Taipei (TW)

( * ) Notice: Subject to any disclaimer, the term of this patent is extended or adjusted under 35 U.S.C. 154(b) by 0 days.

(21) Appl. No.: 10/114,016

(22) Filed: Apr. 1, 2002

(51) Int. Cl.[7] ..... H01R 9/05
(52) U.S. Cl. ..... 439/585; 439/578
(58) Field of Search ..... 439/578–585

(56) References Cited

U.S. PATENT DOCUMENTS 5,651,698 A * 7/1997 Locati et al. ..... 439/578
5,938,474 A * 8/1999 Nelson ..... 439/578
6,033,260 A * 3/2000 Murata et al. ..... 439/578

* cited by examiner

*Primary Examiner*—Gary Paumen

(74) *Attorney, Agent, or Firm*—Troxell Law Office PLLC

(57) ABSTRACT

A coaxial connector including a connector main body disposed with a front end extending portion and a rear end extending portion for receiving a free end of a coaxial cable. The inner portion of the rear end extending portion is disposed with a ring sleeve. The ring sleeve has a small diameter portion and a big portion jointed with the end portion of the small diameter portion. The small diameter portion and the rear end extending portion are concentrically circled around each other with a ring hollow in the center. A tool is used to reduce the diameter of the rear end extending portion to force the small diameter and an aluminum shield body of the cable to form a good connection. The small diameter provides a flexible deforming space for assuring a long-term and dependable electrical connection.

4 Claims, 6 Drawing Sheets

COAXIAL CONNECTOR

BACKGROUND OF THE INVENTION

1. Field of the Invention

The present invention relates to a coaxial connector, more especially to a connector with both a connector main body and a ring sleeve squeezed by a squeezing device to compress and deform inwardly so as to force the sleeve and the aluminum shield body form a good connection. Thereby, the connector body is completely and tightly jointed with an external surface of a cable. The ring sleeve and the connector main body are concentrically circled around each other with a ring hollow in the center for providing the ring sleeve a flexible deforming space so as to assure a long-term and dependable electrical connection.

2. Description of the Prior Art

Accordingly, generally the cable television system, the wireless television system and the shared-antenna television system are all deployed from a main line connected to a distributor; from the distributor, subdivided lines are drawn to connect to the users for purpose of receiving the signal transmitted from the television system. On the main line, the distal end of a coaxial cable is jointed with a coaxial connector installed on the distributor. A conventional coaxial connector is shown in FIGS. 1A and 1B. The function of the available coaxial connector is to make a good connection between a coaxial shield body and a connector main body for transmitting electrical signals. The coaxial connector (100) includes a connector main body (101) with one end thereof threaded with a sleeve (102). The inner portion of the connector main body (101) is formed into a hole (103). The inner portion of the hole (103) is coaxially disposed with an axial ring (104), a clamping element (105) and a contacting conductor (106). One end of the connector main body (101) is a connecting end portion (107) disposed with external threads (108) thereon. One terminal end of the hole (103) is a slope (109).

A hole (110) is formed on the inner portion of the sleeve (102). The inner portion of the hole (110) is coaxially disposed with a spring ring (111). As shown in FIG. 1C, the inner portion of the spring ring (111) is formed into a plurality of meshing grooves (112) and an open slot (113) penetrating through the spring ring (111). The terminal end of the hole (110) has inner threads (114) to be threaded with the external threads (108) on the connector main body (101) thereby to joint the connector main body (101) and the sleeve (102) into one unit.

When assembling the coaxial connector (100) and the coaxial cable (200), firstly, the free end of the coaxial cable (200) is peeled to make an aluminum shield body (201) and a core wire (202) expose outside an external cover (203). Secondly, the sleeve (102) is slid into the coaxial cable (200). Thirdly, the connector main body (101) and the sleeve (102) are threaded. At this time, the connecting end portion (107) is located on the external portion of the spring ring (111) and the axial ring (104) is on the inner portion of the aluminum shield body (201). Therefore, the inward movement of the connecting end portion (107) reduces the diameter of the spring ring (111) under the radial compression from the slope (109) until the aluminum shield body (201) of the coaxial cable (200) is forced tightly. Thereby, the core wire (202) inside the coaxial cable (200) is forced to joint with the contacting conductor (106) to form electrical connection.

It is obviously that the shortcoming of the abovementioned assembly procedures of the conventional coaxial connector is that it is very complicate and reduces workers' working efficiency. Furthermore, since the spring ring (11) tightly covers the external portion of the aluminum shield body (201), that is the contact between hard properties, the environmental or other factors, such as the vibration generated by heat expansion and cold shrinkage of the air as well as the wind blowing, or the hardness fatigue of the material itself will cause the clamp between the spring ring (111) and the aluminum shield body (201) to loosen and that might cause the coaxial shield body (201) and the connector main body (101) to fail. Furthermore, that might reduce the electrical signal transmission. The situation might be worse especially for the digital transmission. In order to prevent such ocurrence, annually, workers have to forcefully tighten the connection between the connector main body (101) and the sleeve (102); that kind of solution increases the required cost and time.

SUMMARY OF THE INVENTION

The primary of the present invention is to provide a coaxial connector. Under compression, a connector main body of the coaxial connector makes a ring sleeve and an aluminum shield body of a coaxial cable form a good connection. The distal end of the connector main body completely and tightly joints with the external surface of the cable. The ring sleeve and the connector main body are concentrically circled around each other with a ring hollow in the center for providing the ring sleeve a flexible deforming space so as to assure a long-term and dependable electrical connection.

To enable a further understanding of the abovementioned objective, the features and applied techniques of the present invention, the brief description of the drawings below is followed by the detailed description of the preferred embodiment.

DETAILED DESCRIPTION OF THE PREFERRED EMBODIMENTS

Figure 9:
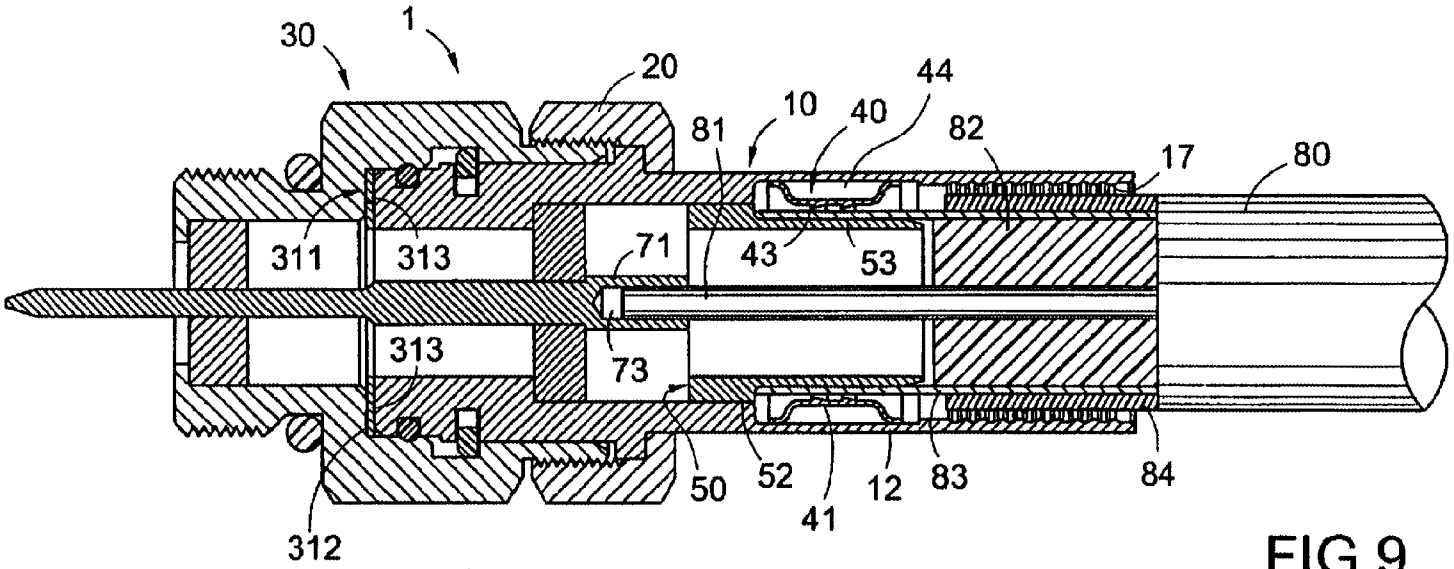
FIG. 9 is a cross-sectional drawing of a cable inserted to the ultimate position in the coaxial connector of the present invention.

As indicated in FIG. 9, a conventional coaxial cable (80) includes a central conductor (81), an insulating body (82), an aluminum shield body (83) and a hard external cover (84).

Figure 1A:
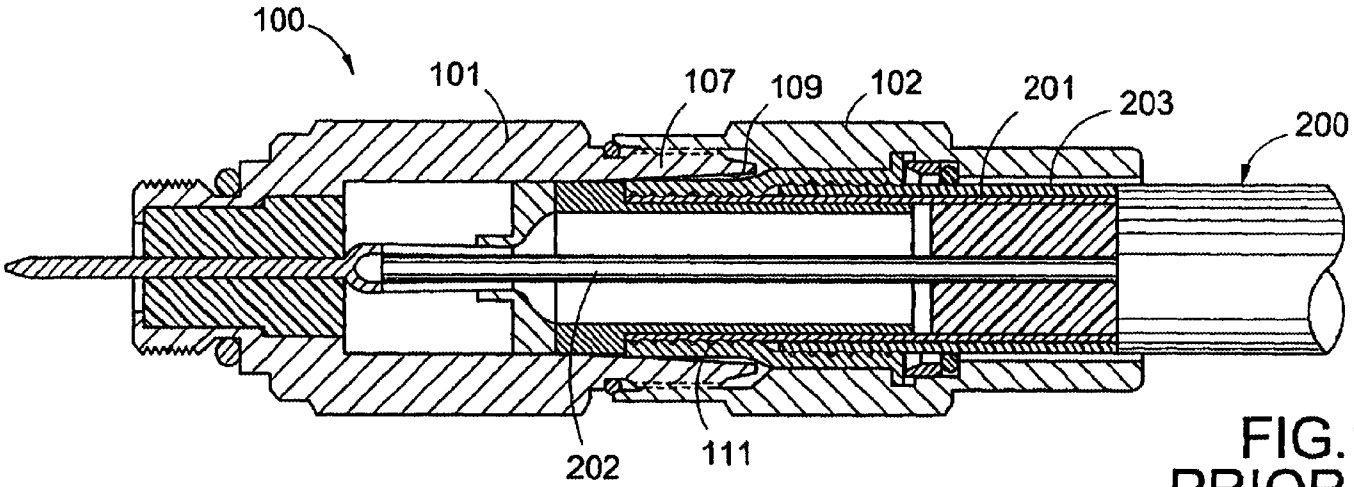
FIG.1A PRIOR ART
FIGS. 1A and 1B are cross-sectional drawings of a conventional coaxial connector.
Figure 1B:
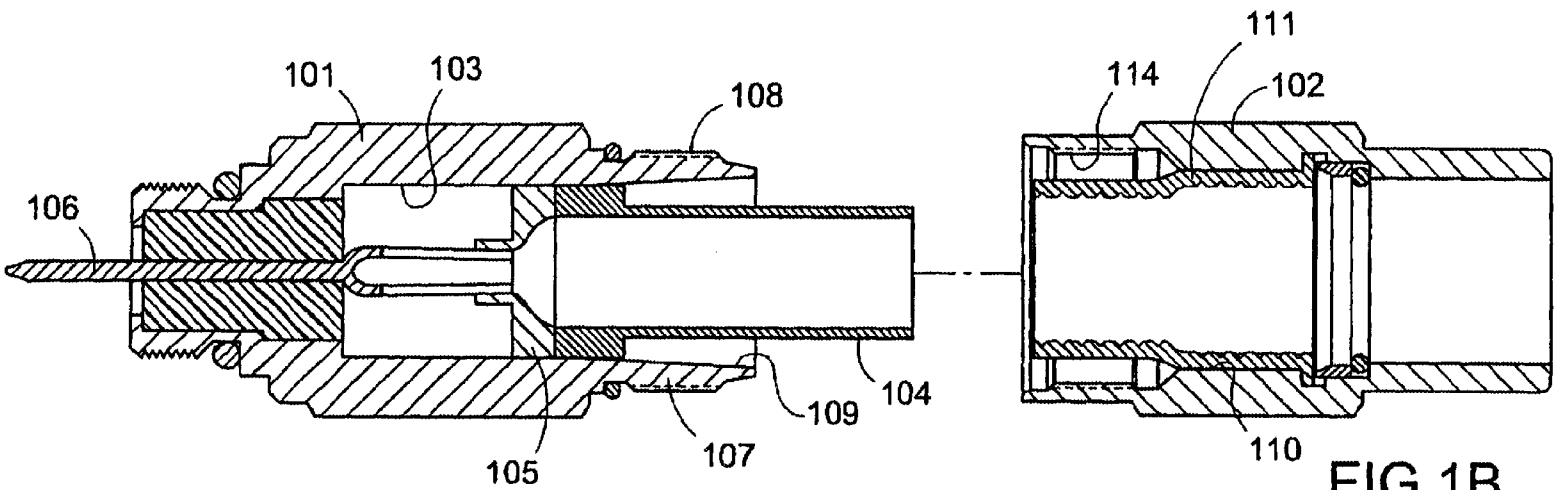
FIG.1B PRIOR ART
Figure 1C:
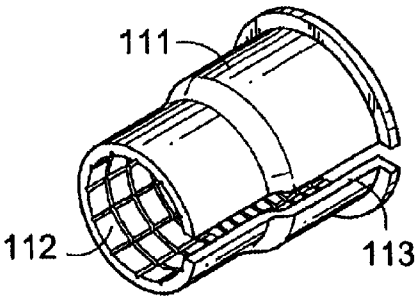
FIG.1C PRIOR ART
FIG. 1C is a pictorial view drawing of a conventional spring ring.
Figure 2:
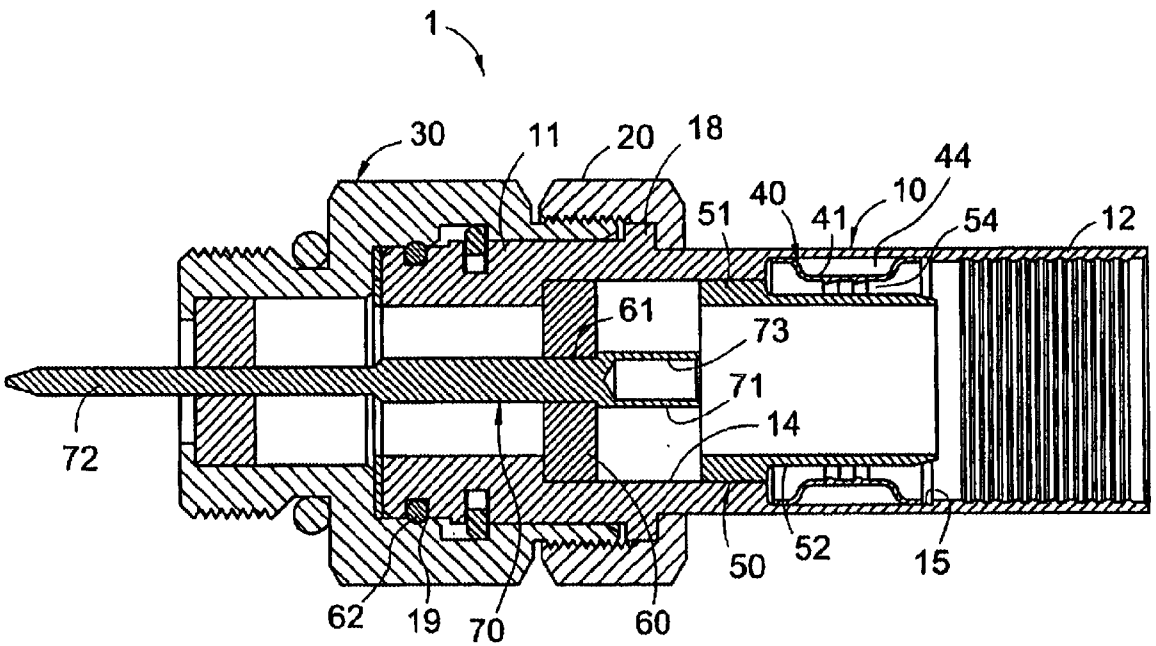
FIG. 2 is a cross-sectional drawing of a coaxial connector of the present invention.

As indicated in FIG. 2 of the entire cross-sectional drawing of a coaxial connector (1) of the present invention, the coaxial connector (1) comprises a connector main body (10), a connecting member (20) and a retaining member (30) to joint the connector main body (10) and the retaining member (30). The connector main body (10) comprises a ring sleeve (40), a ring and columnar member (50), a supporting seat (60) and a tube sleeve (70).

Figure 3:
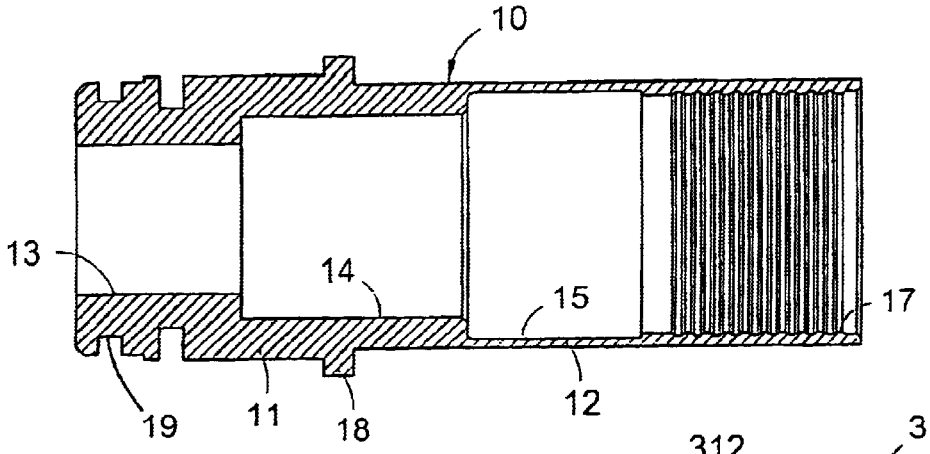
FIG. 3 is an entire cross-sectional drawing of a connector main body of the present invention.

The pictorial and cross-sectional drawing of FIG. 3 indicates an example of the connector main body (10). The connector main body (10) can be made of metal material with a front end extending portion (11), a rear end extending portion (12), a first, second and third through holes (13, 14, 15) communicating through the inner portion thereof. The distal end of the third through hole (15) is formed into a plurality of circular rib rings (17) with a diameter dimensioned to receive the free end of the coaxial cable (80). An outward flange (18) is formed on the external surface of the connector main body (10) and situated between the front end extending portion (11) and the rear end extending portion (12).

The connector main body (10) further comprises an arch shoulder (19) dimensioned to receive a sealing member (62) which is an O-shaped ring made by synthetic rubber or flexible material such as neoprene.

Figure 4:
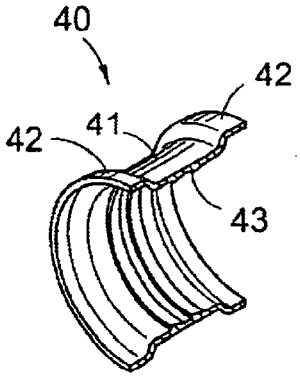
FIG. 4 is an entire pictorial view and cross-sectional drawing of a ring sleeve of the present invention.

The pictorial and cross-sectional drawing in FIG. 4 indicates an example of the ring sleeve (40). The sleeve (40) can be made of thin metal material with a small diameter portion (41) and a big diameter portion (42). The inner surface of the small diameter portion (41) is formed into a plurality of saw teeth (43) with a diameter dimensioned to receive the free end of the coaxial cable (80). The big diameter portion (42) is formed on two lateral end portions of the small diameter portion (41) and is coaxially disposed inside the third through hole (15) of the connector main body (10). As shown in FIG. 2, the small diameter portion (41) of the sleeve (40) and the rear end extending portion (12) of the connector main body (10) are concentrically circled around each other with a ring hollow (44) in the center. The ring hollow (44) provides the small diameter portion (41) a deforming space for compression.

Figure 5:
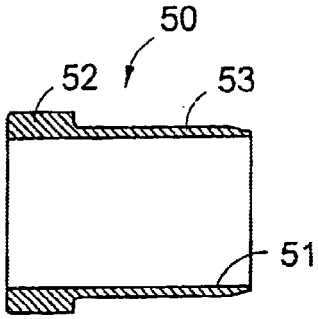
FIG. 5 is an entire cross-sectional drawing of a columnar member of the present invention.

The cross-sectional drawing in FIG. 5 indicates an example of the columnar member (50) and which can be made of metal material to have a flange end portion (52), a tube interface portion (53) and a communicating drill hole (51). The dimension of the flange end portion (52) can be fitly inserted into the second through hole (14) of the connector main body (10). The outer diameter and the wall thickness of the interface portion (53) is smaller than that of the flange end portion (52) and forms a concentrically circling relationship with the small diameter portion (41) of the sleeve (40). The center inbetween is a ring hollow (54).

As indicated in FIG. 2, the ring supporting seat (60) is inserted into the second through hole (14) of the connector main body (10). The supporting seat has a drill hole (61) with a diameter dimensioned to receive the tube sleeve (70). The tube sleeve (70) is made of metal material with a contacting core portion (72) on one end and an insert cotter (71) on the other end thereof. The insert cotter (71) has an insert cotter hole seat (73) for receiving the central conductor (81) of the coaxial cable (80) to form mechanical and electrical connection.

Figure 6:
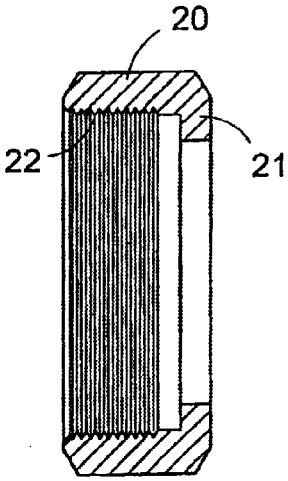
FIG. 6 is an entire cross-sectional drawing of a connecting member of the present invention.

The cross-sectional drawing of FIG. 6 indicates an example of the connecting member (20). The connecting member (20) is jointed on the rear end extend portion (12) of the connector main body (10). The distal end thereof is a flange (21) inserted inwardly and engaged with the outer flange (18). Threads (22) are disposed on the inner portion of the connecting member (20).

Figure 7:
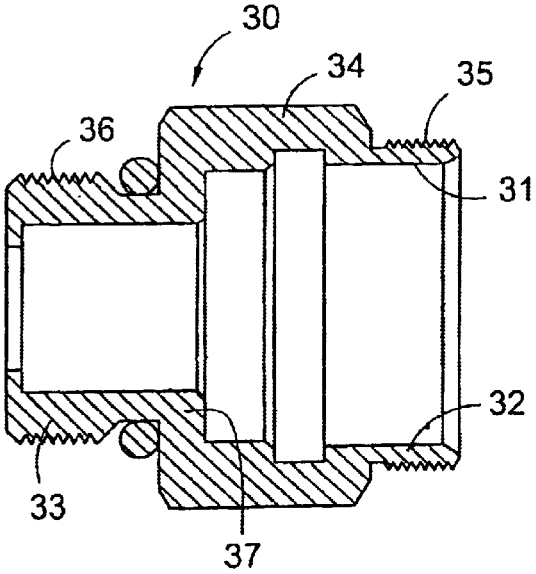
FIG. 7 is a cross-sectional drawing of a retaining member of the present invention.

The cross-sectional drawing of FIG. 7 indicates an example of the retaining member (30). The retaining member (30) is jointed on the front end extending portion (11) of the connector main body (10). It has an inner drill hole (31) with a diameter dimensioned to receive the front end extending portion (11) of the connector main body (10). The retaining member (30) has two ring end portions (32, 33) and one hexagonal body portion (34). The outer portion of the ring end portion (32, 33) has threads (35, 36). The threads (35) are threaded to the threads (22) of the connecting member (20). At this time, the sealing member (62) is sealed to compress between the drill hole (31) of the retaining member (30) and the arch shoulder (19) of the connector member (10) for providing an 360° anti-moisture sealing, as shown in FIG. 2. The threads (36) are received to make the assembly of the coaxial connector (1) and the coaxial cable (80) electrically connect with an electronic device into one unit. The hexagonal body portion (34) is used by means of a spanner or other tools to lock the retaining member (30) onto an electronic member, as shown in FIG. 9.

Figure 8A:
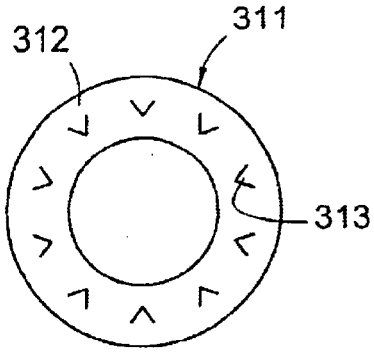
FIGS. 8A and 8B are plane and cross-sectional drawings of a tightening ring of the present invention.
Figure 8B:
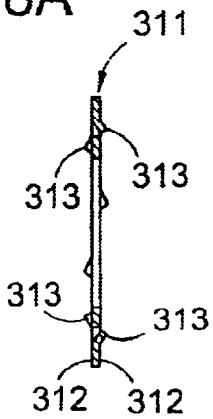
Figure 11:
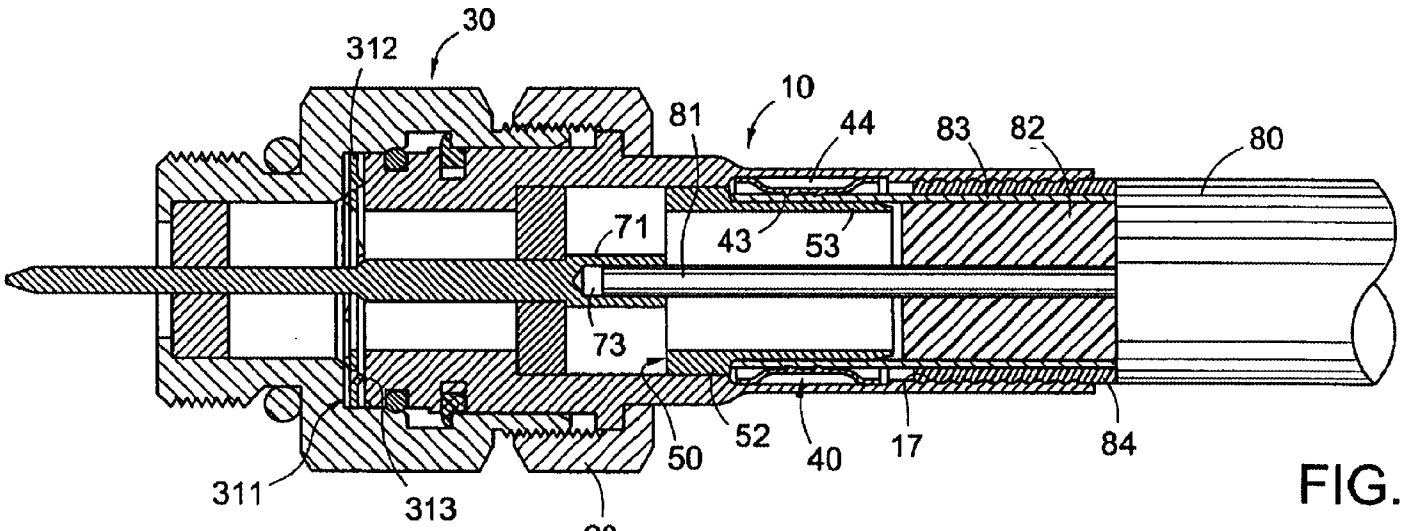
FIG. 11 is a cross-sectional drawing of the loosening situation occurred between the connecting member and the retaining member of the present invention.

As shown in FIGS. 8A and 8B, the retaining member (30) further includes a tightening ring (311) in a body of ring shape. A plurality of convex thorns (313) are punched outwardly on the front end rear plane portions (312). Therefore, at the ultimate position of locking the connecting member (20) and the retaining member (30), the convex thorns (313) on the front and rear plate portions (312) are compressed to approach toward the plane portion (312), as shown in FIG. 9. Once the connecting (20) and the retaining member (30) are loosened due to environmental or external factors, the convex thorns (313) naturally expands outwardly due to its own resilience and forms a good connection inbetween, as shown in FIG. 11.

Figure 10:
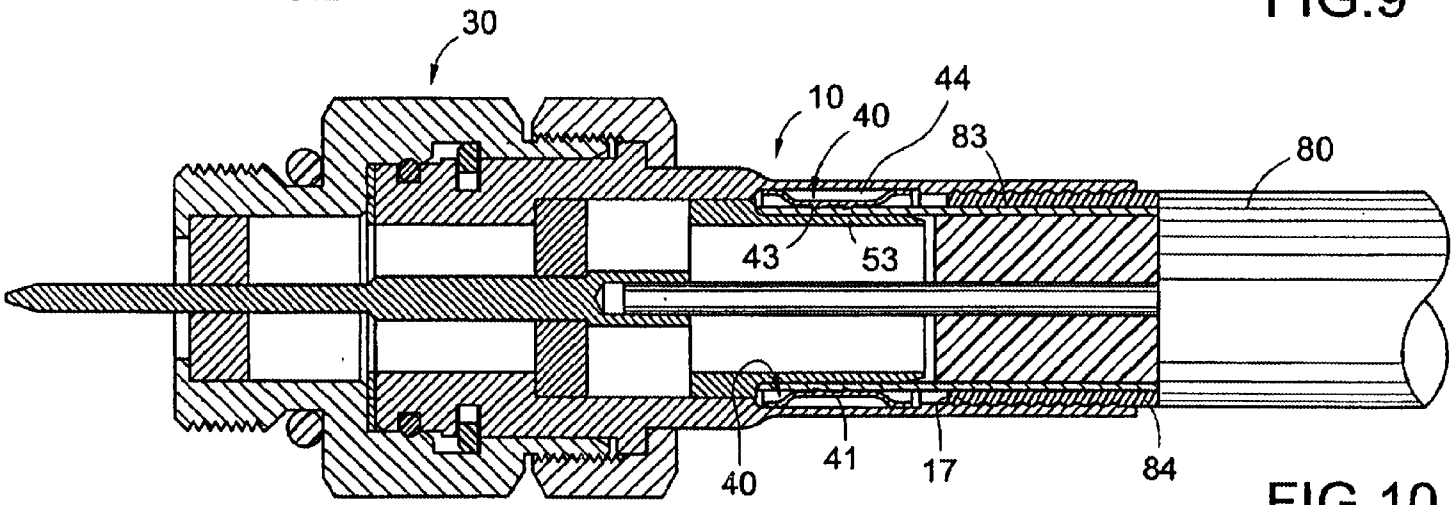
FIG. 10 is a cross-sectional drawing of the compressed joint between the coaxial connector and the cable shown in FIG. 9 of the present invention.

The cross-sectional drawings of FIGS. 9 and 10 indicates an example of the coaxial connector (1) of the present invention jointed to a coaxial cable (80). Firstly, the free end of the coaxial cable (80) is prepared and then the connecting member (20) and the retaining member (30) are jointed to radially compress the tightening ring (311) to force the convex thorns (313) to approach toward the plane portion (312). Secondly, the free end of the cable (80) is inserted to the rear end extending portion (12) of the connector main body (10) until the terminal end of the aluminum shield body (83) is flush with the flange end portion (52) of the columnar member (50). At this time, the central conductor (81) of the cable (80) is inserted into the insert cotter hole seat (73) of the insert cotter (71 ) to form mechanical and electrical connection. During the insertion, the tube interface portion (53) of the columnar member (50) is forced into the aluminum shield body (83) of the cable (80), as shown in FIG. 9. Thirdly, a compressing tool is used to reduce the diameter of the rear end extending portion (12) of the connector main body (10). Therefore, the saw teeth (43) are forced to contact the external surface of the aluminum shield body (83) and form a connection thereby. The rib rings (17) are also forced to tightly connect with the external cover (84), as shown in FIG. 10.

Since the small diameter (41) of the sleeve (40) and the rear end extending portion (12) of the connector main body (10) forms a ring hollow (44) at the center, once under external factors, the coaxial connector (1) changes the clamping relationship among the interface portion (53), the aluminum shield body (83) and the small diameter portion (41). At this time, the small diameter portion (41), based on its own resilience, ceaselessly maintains the tightly forced and clamped relationship with the aluminum shield body (83) and the interface portion (53).

Figure 12:
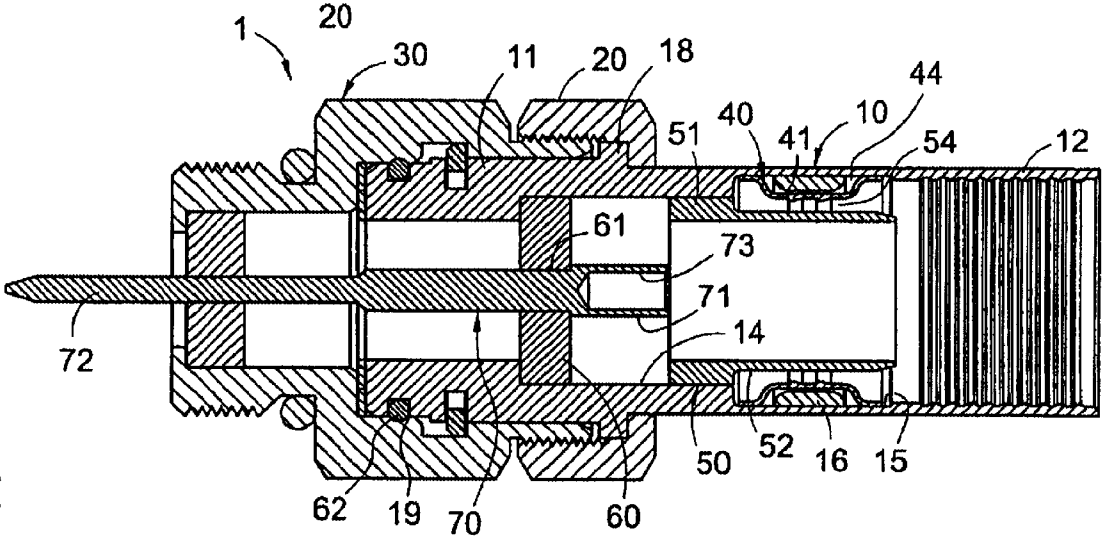
FIGS. 12 to 14 are cross-sectional drawings of a ring washer disposed on the inner portion of a ring hollow between the connector main body and the ring sleeve of the present invention.
Figure 13:
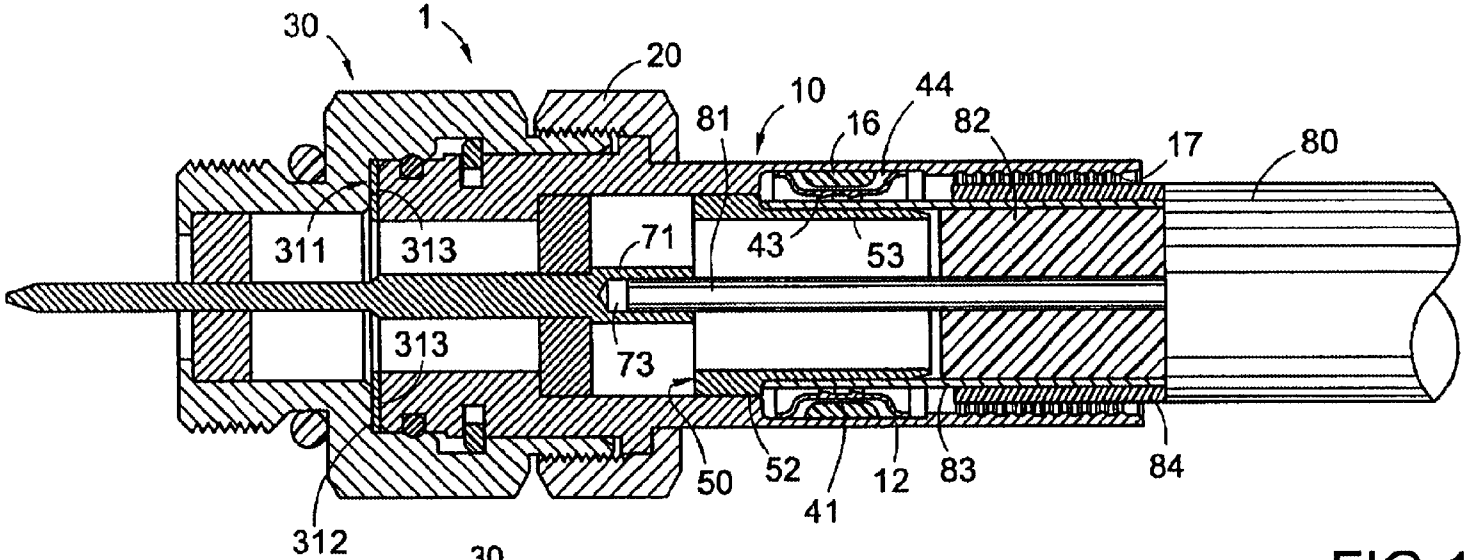
Figure 14:
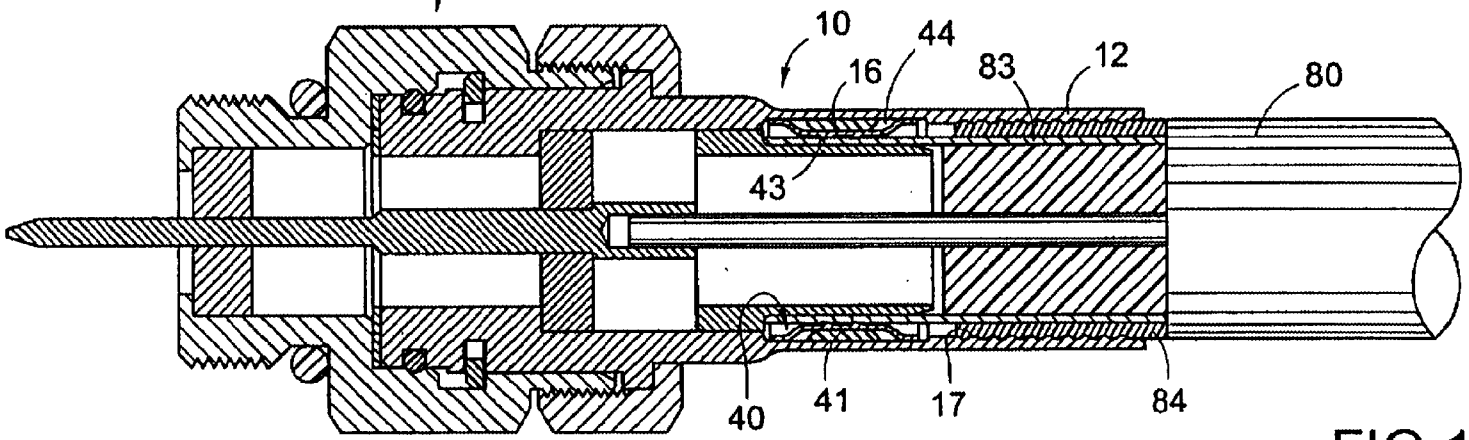

As indicated in FIGS. 12 and 14, a ring washer (16) is disposed in the ring hollow (44) between the small diameter portion (41) and the rear end extending portion (12), as shown in FIG. 12. Therefore, when the coaxial cable (80) is completely inserted into the coaxial connector (1), as shown in FIG. 13, a compressing tool is used to reduce the diameter of the rear end extending portion (12). Thus, the saw teeth (43) are forced to contact the external surface of the aluminum shield body (83) to form a connection. The ring washer (16) is capable of strengthening the tightly forced and clamped relationship among the small diameter portion (41), the aluminum shield body (83) and the interface portion (53), as shown in FIG. 14.

Through the abovementioned description, it is obvious that the rear end extending portion (12) of the connector main body (10) is compressed to reduce the diameter to make the rib ring (17) completely connect with the external cover (84) of the cable (80) so as to achieve the objective of tight engagement; the saw teeth (43) of the sleeve (40) contacts the external surface of the aluminum shield body (83) to achieve the objective of having a good connection. Once connected, the distal end of the retaining member (30) can be easily connected to the electronic device to accomplish the connection for absolutely assuring a long-term and dependable electrical connection.

What is claimed is:

1. A coaxial connector for mechanically and electrically connecting a coaxial cable to an electronic device comprising:

a) a connector main body having:
- i) a first extending portion;
- ii) a second extending portion, the first extending portion and the second extending portion being at opposing ends thereof;
- iii) a first hole through a center thereof;
- iv) a second hole through a center thereof;
- v) and a third hole through a center thereof, the first hole being in the first extending portion, the third hole being in the second extending portion, the second hole being between the first hole and the third hole, the second hole being a larger diameter than the first hole, the third hole being a larger diameter than the second hole;
- vi) a plurality of circular ribs being formed at a distal end of the third hole;
- vii) an outward flange formed on an external surface of the connector main body between the first extending portion and the second extending portion; and
- viii) an arched shoulder extending around an outer circumference of the first extending portion;

b) a connecting member having a inward flange at a first end for engaging the outward flange of the connector main body and internal threads at a second end;

c) a retaining member having:
- i) an inner drill hole, the first extending portion of the connector main body being inserted into the inner drill hole;
- ii) a first ring end portion having external threads, the first ring end portion being threadly connected to the connecting member;
- iii) a second ring end portion having external threads, the first ring end portion and the second ring end portion being at opposing ends thereof; and
- iv) a hexagon body portion on the outer circumference thereof;

d) a ring sleeve having a big diameter portion at opposing ends thereof and a small diameter portion between the big diameter portions, the interior of the small diameter portion having a plurality of saw teeth, the ring sleeve being positioned within the third hole of the connector main body;

e) a columnar member having a flange end portion and a tube interface portion for forcibly engaging an aluminum shield body of the coaxial cable, the outer diameter of the of the tube interface portion being smaller than the outer diameter of the flange end portion, the flange end portion being fitly inserted into the second hole of the connector main body, the tube interface portion being inserted into ring sleeve;

f) a ring supporting seat having a through hole and being inserted into the second hole of the connector main body; and g) a tube sleeve having a contacting core portion at a first end and an insert cotter having an insert cotter hole seat at a second end, the tube sleeve being inserted into the hole in the ring support seat such that a central conductor of the coaxial cable is inserted into the insert cotter hole seat, such that a compression force applied to the second extending portion will force the small diameter portion of the ring sleeve to tightly engage the tube interface portion with the aluminum shield body of the coaxial cable there between and the plurality of rib rings of the second extending portion to securely engage an external cover of the coaxial cable.

2. The coaxial connector for mechanically and electrically connecting a coaxial cable to an electronic device according to claim 1, further comprising a ring washer positioned between the small diameter portion of the ring sleeve and the second extending portion of the connector main body.

3. The coaxial connector for mechanically and electrically connecting a coaxial cable to an electronic device according to claim 1, further comprising a tightening ring having a plurality of convex thorns extending from two opposing faces, the tightening ring being positioned between the connector main body and the retaining member, such that the plurality of convex thorns provide a resilient force against the connector main body and the retaining member.

4. The coaxial connector for mechanically and electrically connecting a coaxial cable to an electronic device according to claim 1, further comprising a sealing member inserted into the arch shoulder of the connector main body.

* * * * *